US007725054B2

(12) United States Patent
Fujita et al.

(10) Patent No.: US 7,725,054 B2
(45) Date of Patent: May 25, 2010

(54) ELECTRIFYING APPARATUS, A PROCESSING UNIT, AND AN IMAGE FORMATION APPARATUS

(75) Inventors: Tetsumaru Fujita, Hyogo (JP); Yoshio Sakagawa, Hyogo (JP); Yuji Nagatomo, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 152 days.

(21) Appl. No.: 11/954,402

(22) Filed: Dec. 12, 2007

(65) Prior Publication Data

US 2008/0152384 A1 Jun. 26, 2008

(30) Foreign Application Priority Data

Dec. 22, 2006 (JP) ..... 2006-345331

(51) Int. Cl.
*G03G 15/02* (2006.01)
*G03G 21/00* (2006.01)

(52) U.S. Cl. ..... 399/128; 399/149; 399/174

(58) Field of Classification Search ..... 399/128, 399/129, 50, 174, 175, 176, 149, 150; 430/110.4, 430/108.1
See application file for complete search history.

(56) References Cited

U.S. PATENT DOCUMENTS 5,809,373 A * 9/1998 Yoda et al. ..... 399/129 X
6,173,143 B1 * 1/2001 Hirota et al. ..... 399/176
6,403,270 B2 * 6/2002 Itami et al. ..... 430/59.5
7,232,635 B2 * 6/2007 Kobayashi et al. ..... 399/174 X
2002/0025184 A1 * 2/2002 Ishikawa et al. ..... 430/110.4 X
2002/0034703 A1 * 3/2002 Yamazaki et al. ..... 430/108.1 X
2002/0119387 A1 * 8/2002 Ishida et al. ..... 430/110.4
2003/0118372 A1 * 6/2003 Kitano et al. ..... 399/176
2003/0152856 A1 * 8/2003 Mizoe et al. ..... 430/108.1
2005/0069801 A1 * 3/2005 Yamasaki et al. ..... 430/108.1 X
2006/0210308 A1 * 9/2006 Iwasaki et al. ..... 399/129
2007/0065179 A1 3/2007 Fujita ..... 399/175
2007/0172259 A1 7/2007 Fujita ..... 399/175
2007/0253739 A1 * 11/2007 Kagawa ..... 399/176
2007/0280735 A1 12/2007 Nagatomo et al.
2008/0166154 A1 * 7/2008 Watanabe et al. ..... 399/174
2009/0041491 A1 2/2009 Shono et al.

FOREIGN PATENT DOCUMENTS

JP 2005-62737 3/2005
JP 3747633 12/2005

* cited by examiner

*Primary Examiner*—Sophia S Chen
(74) *Attorney, Agent, or Firm*—Oblon, Spivak, McCelland, Maier & Neustadt, L.L.P.

(57) ABSTRACT

An electrifying apparatus, a processing unit including the electrifying apparatus, and an image formation apparatus including the electrifying apparatus. The electrifying apparatus includes a conductive sheet for electrifying at least one of a surface of a photoconductor and toner adhered to the surface. The conductive sheet is specified to have a pure-water contact angle equal to or greater than 108 degrees, and to have a shore D hardness equal to or less than 65.

12 Claims, 3 Drawing Sheets

ELECTRIFYING APPARATUS, A PROCESSING UNIT, AND AN IMAGE FORMATION APPARATUS

BACKGROUND OF THE INVENTION

1. Field of the Invention

The present invention relates to an electrifying apparatus for electrifying (charging) at least one of the surface of a latent-image supporting object, such as a photoconductor, and toner adhered to the surface by a conductive member to which bias is supplied while the conductive member is contacting the surface of the latent-image supporting object. The present invention further relates to a processing unit and an image formation apparatus using the electrifying apparatus.

2. Description of the Related Art

Generally, image formation apparatuses that employ an electronic photography method form an image according to the following processes. Namely, a electrostatic latent image is formed by exposure scanning a latent-image supporting object, such as a photoconductor, that is uniformly electrified; then the electrostatic latent image is developed into a toner image by a development apparatus. Subsequently, the toner image is either directly transferred onto a recording object such as paper from the latent-image supporting object, or transferred to the recording object through a middle transfer object.

According to a conventional electrifying apparatus used by the image formation apparatuses, an electric bias is provided to an electrifying roller serving as a conductive member that touches the surface of the latent-image supporting object so that the surface of the latent-image supporting object may be uniformly electrified by the conductive member.

Further, Patent Reference 1 discloses an electrifying apparatus that includes an auxiliary electrifying apparatus, to which auxiliary electrifying apparatus an auxiliary electric bias is provided. The auxiliary electrifying apparatus is provided in addition to a main electrifying apparatus for principally electrifying the latent-image supporting object such as an electrifying roller and an electrifying charger of a scorotron method. The auxiliary electrifying apparatus contacts a part of the peripheral surface of the latent-image supporting object, which is endlessly moving, after the latent image supporting object passes a transfer process location and before advancing into a location of a main electrifying process to be performed by the main electrifying apparatus. In this way, auxiliary electrifying of the surface of the latent-image supporting object is carried out and residual toner adhered to the surface is charged to have a regular polarity by discharging or charge injection by the auxiliary electrifying apparatus before the uniform electrifying is performed by the main electrifying apparatus. Thereby, charge unevenness of the latent-image supporting object can be reduced, and background dirt due to residual toner with a low charge or a reverse charge being conveyed to a development area can be prevented.

With the conventional electrifying apparatuses, if residual toner is fixed to the electrifying apparatus and the auxiliary electrifying apparatus (the conductive member) that contact the latent-image supporting object, discharging and charge injection between the conductive member, the residual toner, and the latent-image supporting object are interfered with. Accordingly, the main electrifying and the auxiliary electrifying are degraded; therefore, charge unevenness is generated, and electrifying of the residual toner is degraded, causing the background dirt to be generated. Here, the background dirt is a phenomenon of the toner adhering to the background part (uniformly charged part) of the latent-image supporting object.

Then, an electrifying apparatus disclosed by Patent Reference 2 specifies that the electrifying apparatus have a pure-water contact angle of greater than 90 degrees so that the toner adhesion to the electrifying apparatus is reduced.

[Patent Reference 1] JPA 2005-62737

[Patent Reference 2] JPA 11-352752

However, the inventors of the present invention found out by experiments that the toner adhesion to the conductive member, such as the electrifying apparatus, could not be reduced over a long period of time by only satisfying the condition that the pure-water contact angle be comparatively great. For example, a conductive member having a pure-water contact angle of 100 degrees caused toner adhesion after printing out thousands of sheets.

SUMMARY OF THE INVENTION

The present invention is made in view of the above situation, and provides an electrifying apparatus, a processing unit, and an image formation apparatus using the electrifying apparatus that is capable of reducing charge unevenness and ground dirt due to toner adhesion to a conductive member for a long period of time.

That is, the present invention provides an electrifying apparatus, a processing unit, and an image formation apparatus using the electrifying apparatus that substantially obviate one or more of the problems caused by the limitations and disadvantages of the related art.

Features of embodiments of the present invention are set forth in the description that follows, and in part will become apparent from the description and the accompanying drawings, or may be learned by practice of the invention according to the teachings provided in the description. Problem solutions provided by an embodiment of the present invention may be realized and attained by an electrifying apparatus, a processing unit, and an image formation apparatus therewith particularly pointed out in the specification in such full, clear, concise, and exact terms as to enable a person having ordinary skill in the art to practice the invention.

To achieve these solutions and in accordance with an aspect of the invention, as embodied and broadly described herein, an embodiment of the invention provides an electrifying apparatus, a processing unit, and an image formation apparatus as follows.

Means for Solving a Subject

An aspect of the embodiment of the present invention provides an electrifying apparatus for electrifying at least one of the surface of a latent-image supporting object and toner adhered to the surface of the latent-image supporting object by a conductive member to which a bias voltage is provided while the electrifying apparatus contacts the surface of the latent-image supporting object that supports a latent image, wherein the pure-water contact angle of the surface of the conductive member is equal to or greater than 108 degrees, and the shore D hardness of the surface is equal to or less than 65.

According to another aspect of the embodiment, the shore D hardness of the surface of the conductive member of the electrifying apparatus is equal to or greater than 50.

According to another aspect of the embodiment, the surface resistivity of the conductive member of the electrifying apparatus is between $10^2$ Ω/cm$^2$ and $10^8$ Ω/cm$^2$.

According to another aspect of the embodiment, the volume specific resistance of the conductive member of the electrifying apparatus is between $10^2$ Ω-cm and $10^6$ Ω-cm.

According to another aspect of the embodiment, the surface roughness Ra of the conductive member of the electrifying apparatus is between 0.1 μm and 0.6 μm.

The embodiment further provides a processing unit that is attachable to/detachable from the main body of an image formation apparatus, wherein the processing unit holds the electrifying apparatus and the latent-image supporting object in one body with a common supporting member. Here, the image formation apparatus includes a latent-image supporting object for supporting a latent image, a latent-image formation unit for forming the latent image onto the latent-image supporting object, a developing unit for developing the latent image on the latent-image supporting object with toner, and the electrifying apparatus for electrifying at least one of the latent-image supporting object and the toner adhered to the surface of the latent-image supporting object.

The embodiment further provides an image formation apparatus that includes a latent-image supporting object for supporting a latent image, a latent-image formation unit for forming the latent image onto the latent-image supporting object, a developing unit for developing the latent image on the latent-image supporting object with toner, and the electrifying apparatus as described above for electrifying at least one of the latent-image supporting object and the toner adhered to the surface of the latent-image supporting object.

According to another aspect of the embodiment, as for the image formation apparatus, the length of a section where the latent-image supporting object and the conductive member make contact in a direction of surface movement of the latent-image supporting object is between 2 mm and 7 mm.

According to another aspect of the embodiment, as for the image formation apparatus, contact pressure between the latent-image supporting object and the conductive member is between 2 kN/$m^2$ and 15 kN/$m^2$.

According to another aspect of the embodiment, as for the image formation apparatus, the pure-water contact angle of the latent-image supporting object is greater than 90 degrees.

According to another aspect of the embodiment, as for the image formation apparatus, the toner contains an external additive at a density of 1 through 4 part(s) by weight of the toner particles.

According to another aspect of the embodiment, as for the image formation apparatus, toner particles having a diameter less than 5 μm are less than 15% of the total of the toner particles.

The image formation apparatus according to an aspect of the embodiment develops the latent image into a toner image using the developing unit with toner that is held on the surface of a developer supporting object, transfers the toner image formed on the surface of the latent-image supporting object by the developing unit to a transfer object using a transfer unit, and residual toner remaining on the latent-image supporting body is recouped to the surface of the developer supporting object after the transfer process is performed by the transfer unit.

EFFECTIVENESS OF INVENTION

Since, according to the embodiment of the invention, the surface pure-water contact angle of the conductive member is greater than 108 degrees, and the surface shore D hardness of the conductive member is 65 or less, toner adhesion to the conductive member is reduced over a long period of time as evidenced by experiments conducted by the inventors of the present invention as described below. Accordingly, generating the charge unevenness and ground dirt due to toner adhesion to the conductive member are reduced over a long period of time.

DESCRIPTION OF THE PREFERRED EMBODIMENTS

In the following, embodiments of the present invention are described with reference to the accompanying drawings.

According to the embodiments, the present invention is applied to an image formation apparatus, and the image formation apparatus is a color laser printer (printer) of an electro photographic method.

Figure 1:
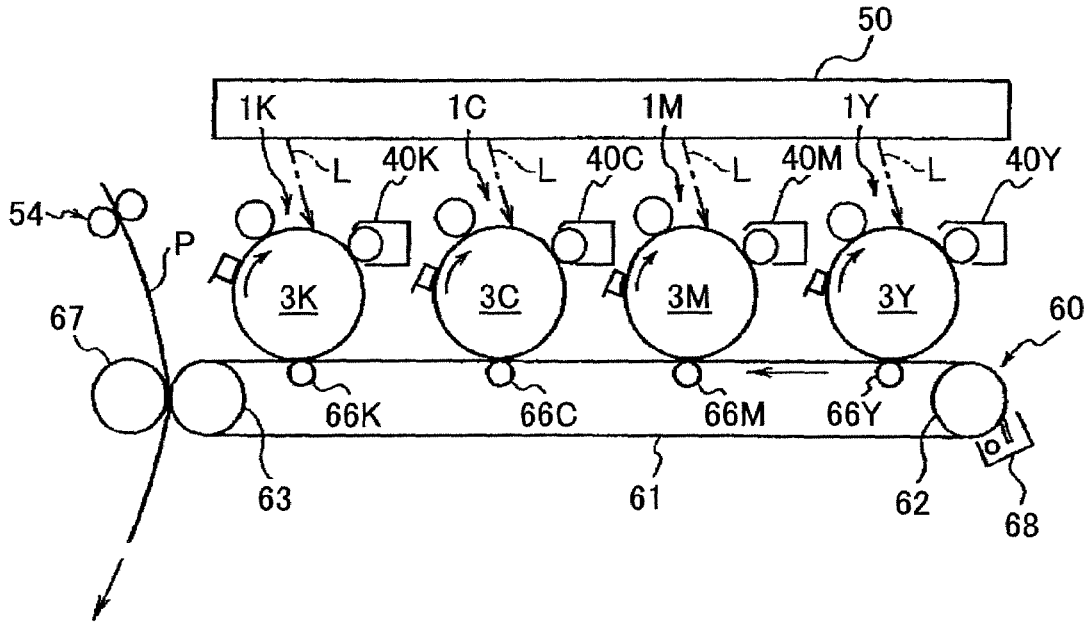
FIG. 1 is a schematic diagram of the principal part of a printer according to an embodiment of the present invention.

First, the basic configuration of the printer according to the embodiment is described. FIG. 1 shows an outline of the principal parts of the printer according to the embodiment. The printer includes four processing units, namely, 1Y, 1M, 1C and 1K for forming toner images in colors of yellow (Y), magenta (M), cyan (C), and black (K), respectively. The printer further includes an optical writing unit 50, a resist roller pair 54, and a transfer unit 60. Where appropriate, suffixes Y, M, C, and K are used for indicating color specific units.

The optical writing unit 50 serves as a latent-image formation unit, and includes a luminous source consisting of four laser diodes for corresponding colors of Y, M, C, and K, a polygon mirror of a regular hexahedron, a motor for rotationally driving the polygon mirror, an fθ lens, a lens, and a reflective mirror. The luminous source emits laser lights L for corresponding colors. The laser lights L are reflected by one of the six faces of the polygon mirror, deflected with rotation of the polygon mirror, and reach one of four photoconductors described below. The surfaces of the four photoconductors are optically scanned by the corresponding laser lights L irradiated by the corresponding laser diodes.

The processing units 1Y, 1M, 1C, and 1K include photoconductors 3Y, 3M, 3C, and 3K, respectively, developing units 40Y, 40M, 40C and 40K, respectively, and corresponding electrifying apparatuses. Each of the photoconductors 3Y, 3M, 3C, and 3K is shaped like a drum, serves as the latent-image supporting object, and is rotationally driven in the clockwise direction in the drawing at a predetermined linear speed by a driving unit that is not illustrated. The photoconductors 3Y, 3M, 3C, and 3K are optically scanned by the optical writing unit 50 that emits the laser lights L modulated by image information provided by an external source such as a personal computer that is not illustrated, and support corresponding electrostatic latent images that are generated for colors Y, M, C, and K, respectively.

Figure 2:
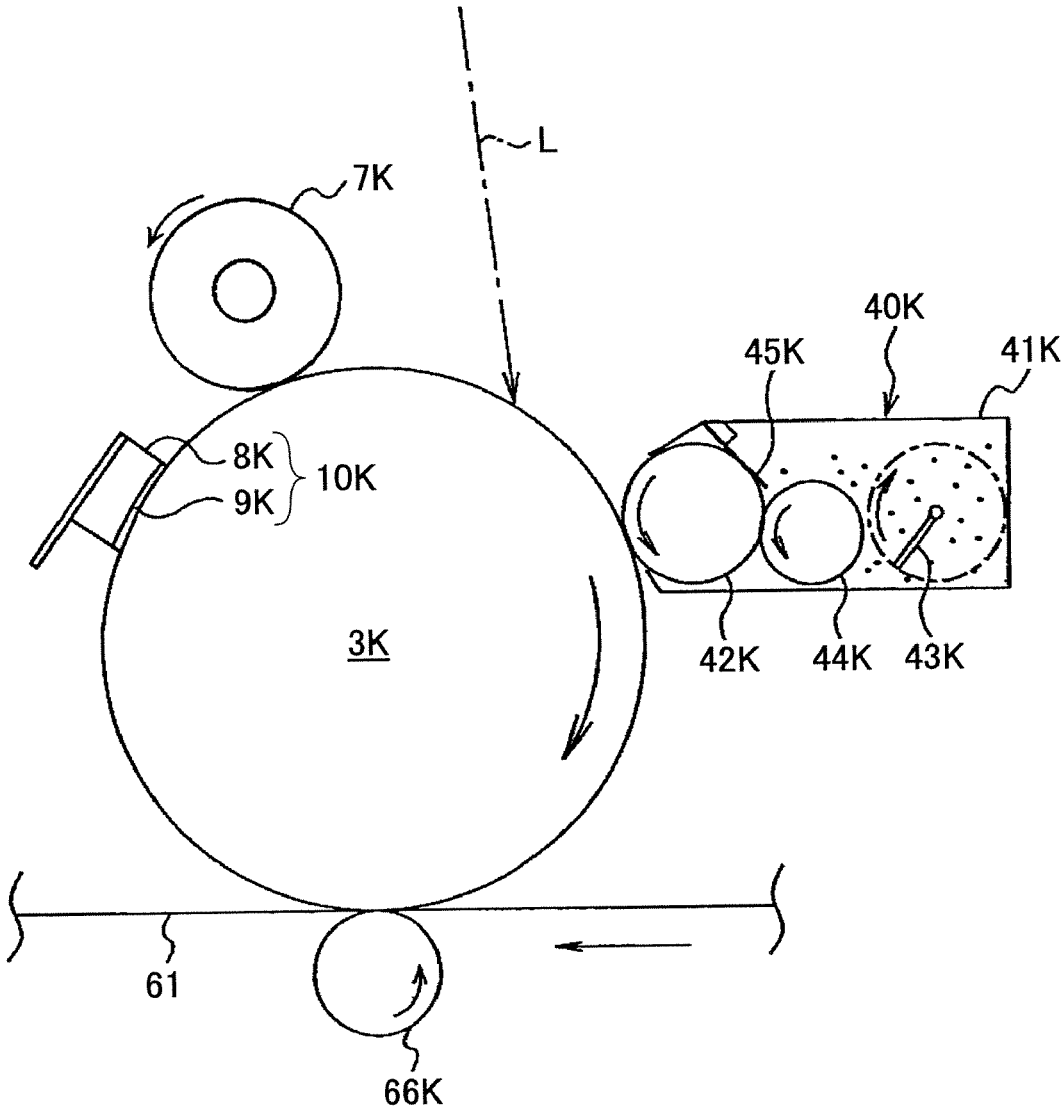
FIG. 2 is a schematic diagram of a processing unit for K of the printer with a middle transfer belt.

FIG. 2 is an expanded schematic diagram showing the processing unit 1K serving as a representative of the four processing units 1Y, 1M, 1C and 1K with a middle transfer belt 61 of a transfer unit 60 (refer to FIG. 1). The processing unit 1K includes a common unit casing (supporting body) containing the photoconductor 3K, a discharging lamp that is not illustrated, and a developing unit 40K. The processing unit 1K is attachable to and detachable from the body of the printer.

The photoconductor 3K, which is a charged body and serves as the latent image supporting object, is shaped like a drum the diameter of which is about 24 mm. The photoconductor 3K is made of an aluminum tube. A photosensitive layer of an organic photoconductor (OPC) having a negative charging property is formed on the surface of the aluminum tube. The photoconductor 3K is rotationally driven in the clockwise direction in the drawing by a driving unit that is not illustrated. In this way, the surface of the photoconductor 3K passes through a primary transfer nip (contacting point with the middle transfer belt 61), an auxiliary electrifying (charging) nip, an electrifying (charging) nip, an optical writing position, and a development area.

The development apparatus 40K for K includes a developing roller 42K, a part of which is exposed through an opening in a casing 41K. The developing roller 42K serving as a developer supporting object is rotationally driven around a shaft supported by bearings (not illustrated). The casing 41K contains toner in K color that is conveyed from the right-hand side to the left-hand side in the drawing by an agitator 43K that is rotationally driven. A toner supply roller 44K is provided on the left-hand side of the agitator 43K, and the toner supply roller 44K is rotationally driven in the counterclockwise direction by a driving unit that is not illustrated. A roller part of the toner supply roller 44K is made of an elastic foam object, such as sponge, so that the K-color toner provided by the agitator 43K can be efficiently received. The K-color toner is supplied to the developing roller 42K at a position where the toner supply roller 44K touches the developing roller 42K. The K-color toner supported by the surface of the developing roller 42K serving as the developer supporting object passes a position where a regulation blade 45K makes contact. The thickness of the toner is regulated and friction charging is promoted with the rotational drive of the developing-roller 42K in the counterclockwise direction. The toner is conveyed to the development area that counters the photoconductor 3K.

In the development area, a development potential that causes the K toner having a negative polarity to move from the developing roller 42K to the latent image is activated between the developing roller 42K, to which a development bias of the negative polarity provided by a power source that is not illustrated is provided, and the electrostatic latent image on the photoconductor 3K. Further, a non-developing potential that causes the K toner having the negative polarity to move from the background part to the developing roller 42K is activated between the uniform charged part (background part) of the developing roller 42K and the photoconductor 3K. The K-color toner supported by the developing roller 42K is transferred from the developing-roller 42K to the electrostatic latent image on the photoconductor 3K by the action of the development potential. In this way, the electrostatic latent image on the photoconductor 3K is developed into a K-color toner image.

In addition, although a single component developer is used by the development apparatus 40K of the printer, a 2-component developer consisting of K toner and a magnetic carrier may be used.

The K-color toner image developed in the development area is conveyed to the primary transfer nip where the photoconductor 3K and the middle transfer belt 61 meet with the rotational movement of the photoconductor 3K, and the toner image is transferred to the middle transfer belt 61. At this point, toner that has not been transferred to the middle transfer belt 61 remains on the surface of the photoconductor 3K after passing the primary transfer nip. Such toner is called residual toner. Handling of the residual toner is described below.

The electrifying apparatus includes an electrifying roller 7K, and an auxiliary electrifying apparatus 10K. The electrifying roller 7K forms an electrifying nip at a position where the photoconductor 3K is contacted as the electrifying roller 7K is rotationally driven counterclockwise as illustrated. The auxiliary electrifying apparatus 10K forms an auxiliary electrifying nip at a position where the photoconductor 3K is contacted. The electrifying roller 7K includes a metal rotational shaft, and a roller part made of a conductive and elastic material, such as conductive rubber. The roller part is provided such that it covers the metal rotational shaft. A bias voltage is provided to the metal rotational shaft by an electric bias supply unit that includes a power source that is not illustrated. By the bias voltage, electric discharge occurs between the electrifying roller 7K and the photoconductor 3K, and the surface of the photoconductor 3K is charged in the same polarity as the toner.

The auxiliary electrifying apparatus 10K includes an elastic part 8K made of an elastic material such as sponge, and a conductive sheet 9K made of a conductive material. The surface of the elastic part 8K is covered by the conductive sheet 9K. The auxiliary electrifying apparatus 10K is pressed toward the photoconductor 3K by a holding member such that the conductive sheet 9K contacts the photoconductor 3K at a position after the primary transfer nip and before the electrifying nip. An auxiliary electric bias supply unit, which consists of a power source that is not illustrated, provides an auxiliary electric bias to the conductive sheet 9K. The auxiliary electric bias is either a DC voltage of the same polarity as the toner, or an AC voltage onto which the DC voltage is superposed.

The residual toner adhered to the surface of the photoconductor 3K after the primary transfer nip includes toner with a regular polarity, toner charged to an insufficient level of the regular polarity, and toner charged with the reverse polarity. The residual toner advances to an auxiliary electrifying nip with the rotation of the photoconductor 3K. Then, the toner charged with the reverse polarity is fully charged to the regular polarity, i.e., negative polarity, by electric discharge between the auxiliary electrifying apparatus 10K and the photoconductor 3K, or by charge injection from the auxiliary electrifying apparatus 10K. Further, the toner of low charge out of the residual toner is also fully charged by discharging or charge injection with the negative polarity. In this way, the ground dirt due to the toner with the reverse polarity and the toner that is insufficiently charged being conveyed to the development area is reduced.

When discharging is to take place between the conductive sheet 9K of the auxiliary electrifying apparatus 10K and the photoconductor 3K, charge unevenness can be prevented by carrying out the auxiliary charging of the photoconductor 3K by the electric discharge in advance of the main charging of the photoconductor 3K by the electrifying roller 7K.

The electrostatic latent image in the K color is formed on the surface of the photoconductor 3K by the optical writing unit 50 scanning the uniformly charged surface, and the electrostatic latent image is developed by the development apparatus 40K into the toner image in the K color.

Since the processing units 1Y, 1M, and 1C for other corresponding colors have the same configuration as the processing unit 1K, descriptions are not repeated.

The processing units 1Y, 1M, 1C, and 1K employ the so-called "cleanerless" method. According to the "cleanerless" method, an image formation process on the latent-image supporting object is performed without using a special unit for cleaning and recovery of the residual toner that is adhered to the latent-image supporting object such as the photoconductor 3K. Here, the special unit is for separating the residual toner from the latent-image supporting object, conveying the separated residual toner to a disposed toner container without adhering the residual toner to the latent-image supporting object again, and/or recycling the separated residual toner in the development apparatus. A cleaning blade that scratches the residual toner from the latent-image supporting object is an example of the special unit described here.

The "cleanerless" method is described in more detail. The method includes a "scatter-pass" type, a "temporarily capture" type, and a combination of the two types. According to the "scatter-pass" type, adhesion of the residual toner to the latent-image supporting object is weakened by scratching the residual toner on the latent-image supporting object with a scattering unit such as a brush that makes sliding contact with the latent-image supporting object. Then, the residual toner on the latent-image supporting object is electrostatically transferred to the developing unit such as the developing roller in the development area or immediately before the development area. The development area is where the developing unit (such as the developing roller and a development sleeve) and the latent-image supporting object meet. In this way, the residual toner is recovered into the development apparatus. In advance of the recovery of the residual toner, the residual toner passes a position for optically writing the latent image. If the amount of the residual toner is comparatively small, there is no inadvertent influence on the latent image. However, if the residual toner includes toner that is charged in a polarity reverse to the regular polarity, such toner is not cleaned, is not recovered onto the developing unit, and causes the ground dirt to be generated. In order to reduce the amount of the ground dirt due to the toner that is charged in reverse, it is desirable to provide a toner electrifying apparatus for electrifying the residual toner on the latent-image supporting object in the regular polarity between a transfer location (for example, primary transfer nip) and a scattering location, or between the scattering location and the development area. The scattering unit may be one of a fixed brush that has two or more brush-filling fibers that consist of conductive fibers stuck on a sheet metal, unit casing, and the like, a brush roller that has two or more brush-filling fibers to a rotating metal shaft, and a roller (for example, an electrifying roller) that is made of conductive sponge, and the like. The fixed brush has an advantage that it can be constituted with a small amount of the brush-filling fibers, and is therefore economical. However, if the fixed brush is to serve also as the electrifying apparatus for carrying out uniform charging of the latent-image supporting object, the fixed brush is not capable of providing sufficiently uniform charging. To the contrary, the brush roller is capable of charging with sufficient uniformity, and thus is more desirable.

According to the "temporary capture" type of the "cleanerless" method, the residual toner is temporarily captured with a capturing unit such as a rotational brush that endlessly contacts the surface of the latent-image supporting object. Then, either after a printing job or between printing jobs, the residual toner captured by the capturing unit is "breathed out" to be transferred to the latent-image supporting object, is then transferred to the developing unit such as the developing roller by electrostatic force, and the residual toner is recovered into the development apparatus. According to the "scatter-pass" type, if the amount of the residual toner is great (such as when a solid image is formed and when a jam takes place) in excess of the recovering capacity of the developing unit, image formation may be degraded. In contrast, according to the "temporary capture" type, the residual toner captured by the capturing unit can be collected little by little into the developing unit, and the image formation degradation can be reduced.

The "cleanerless" method may be implemented by combining the "temporary capture" type and the "scatter-pass" type. Specifically, the rotational brush that contacts the latent-image supporting object serves as both scattering unit and capturing unit. The rotational brush functions as the scattering unit if a DC voltage is provided to the rotational brush, and functions as the capturing unit if a superposed voltage (DC+AC) is provided.

According to the embodiment, the printer employs a "scattering-penetration" type "cleanerless" method. Specifically, the photoconductor 3K contacts the outer surface of the middle transfer belt 61, and forms the primary transfer nip for K, while the photoconductor 3K is rotationally driven at a predetermined linear speed in the clockwise direction as shown by an arrow in FIG. 2. Then, the adhesion of residual toner to the photoconductor 3K is weakened by scratching the residual toner on the photoconductor 3K with the electrifying roller 7K and the auxiliary electrifying apparatus 10K (serving as the scattering unit). Then, in the development area, the residual toner on the photoconductor 3K is electrostatically collected by the developing roller 42K of the development apparatus 40K. At this time, if the amount of toner of low charge and reverse charge is great, such residual toner is not properly collected by the developing-roller 42K, and the ground dirt is generated.

As shown in FIG. 1, the transfer unit 60 is provided under the processing units 1Y, 1M, 1C, and 1K. The transfer unit 60 includes the middle transfer belt 61 that is endlessly and rotationally driven in the counterclockwise direction. The middle transfer belt 61 is wound around two or more rollers. Specifically, the rollers include a follower roller 62, a driving roller 63, and four primary transfer bias rollers 66Y, 66M, 66C, and 66K.

The follower roller 62, the primary transfer bias rollers 66Y, 66M, 66C, and 66K, and the driving roller 63 touch the inner surface (inner side of a loop formation) of the middle transfer belt 61. The primary transfer bias rollers 66Y, 66M, 66C, and 66K are each made of a metal core that is covered with an elastic body, such as sponge, and are pressed to the photoconductors 3Y, 3M, 3C, and 3K, respectively. In this way, four primary transfer nips for Y, M, C, and K are formed, wherein the photoconductors 3Y, 3M, 3C and 3K contact the outer surface of the middle transfer belt 61 for a predetermined length in the belt movement direction.

A primary transfer bias voltage at a constant current is applied to the metal cores of the primary transfer bias rollers 66Y, 66M, 66C, and 66K by a transfer bias power source (not illustrated). Thereby, transfer charges are provided to the inner surface of the middle transfer belt 61 through the primary transfer bias rollers 66Y, 66M, 66C, and 66K, and a transfer electric field is formed in each of the primary transfer nips between the photoconductors 3Y, 3M, 3C, and 3K and the middle transfer belt 61. In addition, although the printer includes the primary transfer bias rollers 66Y, 66M, 66C, and 66K, other members such as brushes and blades may be used instead. Further, transfer chargers may be used.

Toner images in Y, M, C, and K colors formed on the corresponding photoconductors 3Y, 3M, 3C, and 3K, respectively, are piled up on the middle transfer belt 61 at the corresponding primary transfer nips, which is called a primary transfer. In this way, on the middle transfer belt 61, a 4-color superposed toner image (henceforth 4-color toner image) is formed.

A secondary transfer bias roller 67 is provided countering the driving roller 63 and sandwiching the middle transfer belt 61 such that the secondary transfer bias roller 67 touches the outer surface of the middle transfer belt 61, and a secondary transfer nip is formed. A secondary transfer bias voltage is applied to the secondary transfer bias roller 67 by a voltage supplying unit (not illustrated) that includes a power source and wiring. In this way, a secondary transfer electric field is formed between the secondary transfer bias roller 67 and the driving roller 63 serving as a secondary transfer nip rear-side roller that is grounded. The 4-color toner image formed on the middle transfer belt 61 is conveyed into the secondary transfer nip as the middle transfer belt 61 is rotationally and endlessly driven.

The printer includes a feed cassette (not illustrated) for storing and feeding recording paper P. The topmost sheet of the recording paper P is sent out to a feed way at a predetermined timing. Then, the recording paper P is inserted into a resist nip formed by a resist roller pair 54 that is provided at the end of the feed way.

Both rollers of the resist roller pair 54 are rotationally driven in order to take the recording paper P into the resist nip, and stop the rotational drive shortly after the tip of the recording paper P is pinched by the resist nip. Then, the recording paper P is sent out to the secondary transfer nip at a timing that is in sync with the 4-color toner image on the middle transfer belt 61. In the secondary transfer nip, the 4-color toner image on the middle transfer belt 61 is transferred to the recording paper P by the secondary transfer electric field and nip pressure (secondary transfer), and the full color image is formed on the recording paper P.

Thus, after the full color image is formed on the recording paper P, the recording paper P is discharged from the secondary transfer nip, and is conveyed to a fixing apparatus (not illustrated) so that the full color image is fixed onto the recording paper P.

Residual toner adhering to the surface of the middle transfer belt 61 after passing the secondary transfer nip is removed by a belt cleaning apparatus 68.

Here, the toners for Y, M, C, and K colors of the printer according to the embodiment are of a negative polarity charge. Accordingly, the photoconductors 3Y, 3M, 3C, and 3K are first uniformly charged in the negative polarity by the corresponding electrifying apparatuses. Then, the charge in the negative polarity is reduced with reference to the background by optical scanning, and the toners in the negative polarity are adhered to the corresponding latent images, that is, a negative-positive development method is used.

Next, the printer according to the embodiment is described.

The inventors hereto prepared a testing machine having the same configuration as the printer of the embodiment as shown in FIG. 1. Further, various conductive sheets were prepared for the conductive sheet 9K of the auxiliary electrifying apparatus 10K of the processing unit 1K for the K color (refer to FIG. 2). The conductive sheets were different in respect to the pure-water contact angle and in respect to the shore D hardness. With each of the conductive sheets being used as the conductive sheet 9K, a monochrome half chart (2×2 half-tone gradation images) was continuously printed onto 10,000 A4-size sheets at an image area rate of 5%.

The pure-water contact angle of the conductive sheet was measured by a droplet method using a contact angle meter model CA-DT-A manufactured by Kyowa Interface Science Co., Ltd., following the handling manual of the contact angle meter.

The shore D hardness of the conductive sheet 9K was measured at 25° C. based on a method described in ASTM D-2240.

A DC voltage of −1100 V was used as the electric bias to be provided to the electrifying roller 7K. Further, a DC voltage of −700 V was used as the auxiliary electric bias to be provided to the conductive sheet 9K of the auxiliary electrifying apparatus 10K. With this configuration, by the auxiliary charge provided by the conductive sheet 9K, residual toner of low charge and reverse charge was charged with the regular polarity, i.e., negative polarity, such that generating of ground dirt was reduced. Further, the auxiliary charging of the photoconductor 3K was carried out with the auxiliary electric bias voltage that was smaller than the main electric bias voltage in advance of the main charging by the electrifying roller 7K, and generating of charge unevenness was reduced. If the toner was adhered to the conductive sheet 9K, the auxiliary charge would be degraded and charge unevenness would take place. In this case, a vertical stripe would become conspicuous in the image.

The toner contained toner particles having an average diameter of 8.5 μm, and was manufactured by a grinding method. The toner contained an external additive.

At the time of printing the half chart, the photoconductors 3Y, 3M, 3C, and 3K were rotationally driven at a linear speed of 120 mm/s.

The electrifying roller (for example, 7K) of each color includes a metal rotating shaft having a diameter of 6 mm covered by a conductive rubber layer making the diameter of the electrifying roller be 10 mm ϕ.

Although various kinds of the conductive sheets having different pure-water contact angles and shore D hardnesses were prepared for the conductive sheet 9K of the auxiliary electrifying apparatus 10K, the surface resistivity and the thickness of all of the conductive sheets were $10^5$ Ω/cm$^2$. and 0.1 mm, respectively.

The elastic part 8K of the auxiliary electrifying apparatus 10K was made of 5 mm thick sponge. When the auxiliary electrifying apparatus 10K was pushed toward the photoconductor 3K by the holding member, the elastic part 8K was compressed to a thickness of 2 mm so that the conductive sheet 9K of the auxiliary electrifying apparatus 10K made pressing contact with the photoconductor 3K.

Then, presence/absence of image dirt due to condensed toner lumping was investigated for all the 10,000 printed sheets for every test printing using each of the different kinds of the conductive sheets as the conductive sheet 9K. The toner tended to be condensed at the position where the conductive sheet 9K contacts the photoconductor 3K (refer to FIG. 2). When the toner was condensed and collected to some extent, the toner would fall by gravity from the contact position, would be conveyed to the primary transfer nip, and would cause the image dirt to be generated either indirectly via the middle transfer belt 61 or directly on the recording paper P. The image dirt was evaluated in three steps of "poor" (100 or more toner adhesion dirt spots greater than 0.5 mmϕ/10 sheets), "fair" (100 or more toner adhesion dirt spots greater than 0.5 mmϕ/100 sheets), and "excellent" (no toner adhesion dirt spots in 100 sheets). Here, the tolerance of the image dirt in general commercial printers is either "fair" or "excellent".

Further, presence/absence of a vertical stripe was observed in a printed image of the 10,000th sheet in each test printing. The vertical stripe is generated when the toner is adhered to the conductive sheet 9K and charge unevenness is generated on the photoconductor 3K. The vertical stripe was evaluated in three steps of "poor" (two or more stripes were easily visible), "fair" (less than 10 small/thin stripes were visible if eyes were aided), and "excellent" (no stripes were visible). Here, the tolerance of the stripes in the general commercial printers is either "fair" or "excellent".

Results of the experiments described above are shown in the following Table 1.

| Pure-water contact angle [degrees] | Shore D hardness | Toner adhesion | Image dirt |
|---|---|---|---|
| 114 | 50 | Excellent | Excellent |
| 115 | 65 | Excellent | Excellent |
| 108 | 64 | Excellent | Excellent |
| 108 | 50 | Excellent | Excellent |
| 100 | 64 | Poor | Excellent |
| 108 | 80 | Poor | Excellent |
| 110 | 48 | Excellent | Fair |

As shown in Table 1, when the shore D hardness of the conductive sheet was between 50 and 65 and the pure-water contact angle was equal to or greater than 108 degrees, both image dirt and stripes were made within the tolerance for 10,000 sheet printing. On the other hand, when the shore D hardness was less than 50, image dirt in excess of the tolerance was generated in 10,000 sheet printing. This was considered to be because of the following reason. That is, if the shore D hardness was less than 50, the "softness" of the conductive sheet excessively increased the adhesiveness between the conductive sheet and the photoconductor, which made it difficult for the toner to pass the position where the conductive sheet and the photoconductor were in contact.

Further as shown in Table 1, if the shore D hardness was greater than 65, vertical stripes occurred in excess of the tolerance in the middle of 10,000 sheet printing even if the pure-water contact angle was equal to or greater than 108 degrees. That is, it was difficult to suppress the toner adhesion to the conductive sheet over a long period of time. This was considered to be because of the following reason. That is, if the shore D hardness was greater than 65, the conductive sheet tended not to follow the rotation of the photoconductor, but just rubbed the surface of the photoconductor due to the "hardness" of the conductive sheet even if minute projections in the magnitude of nm to μm on the surface of the conductive sheet were in contact with the photoconductor. Accordingly, fine vibration that would otherwise be generated by sliding contact with the photoconductor by the surface of the conductive sheet was not properly generated. On the other hand, when the shore D hardness of the conductive sheet 9K was 65 or less, the "softness" contributed to the fine vibration. The fine vibration caused the toner adhered to the surface of the conductive sheet to be separated, and the toner easily passed through the contacting position of the conductive sheet and the photoconductor in a short time.

In view of the experiment results described above, the conductive sheet, such as 9K, of the auxiliary electrifying apparatus, such as 10K, of the processing units 1Y, 1M, 1C, and 1K of the printer according to the embodiment is specified as follows:

the shore D hardness is equal to or greater than 50, and equal to or less than 65; and the surface pure-water contact angle is equal to or greater than 108 degrees.

In addition, although the conductive sheet was pushed toward the photoconductor by the elastic part of the auxiliary electrifying apparatus in the experiment described above, a conductive blade of the same quality as the conductive sheet may be employed to contact the photoconductor, one end of which conductive blade is supported, to obtain the same results as shown in Table 1.

Further, although the embodiment employed DC voltage as the electric bias, an AC voltage superimposed on a DC voltage may be used. Furthermore, although the embodiment employed DC voltage as the auxiliary electric bias, an AC voltage superimposed on a DC voltage may be used.

It is desirable that the conductive sheet of the auxiliary electrifying apparatus have a thickness between 50 μm and 2 mm. If the thickness becomes less than 50 μm, durability will be degraded. If the thickness is greater than 2 mm, the flexibility, and therefore the adhesiveness of the conductive sheet are degraded.

It is desirable that a torque generated by the conductive sheet in sliding contact with the photoconductor be between 0.2 and 1.2 N·m in the case that the sliding contact length in an axial direction of the photoconductor is 240 mm. As the torque exceeds 1.2 N·m, the conductive sheet is rapidly worn. As the torque becomes less than 0.2 N·m, the toner rapidly tends to be stuck to the conductive sheet due to weakened sliding contact force between the conductive sheet and the photoconductor.

It is desirable that the surface resistivity of the conductive sheet of the auxiliary electrifying apparatus be between $10^2$ ω/cm$^2$ and $10^8$ Ω/cm$^2$. If the surface resistivity is less than $10^2$ Ω/cm$^2$, a current flowing between the conductive sheet and the photoconductor degrades electric discharging between the conductive sheet and the photoconductor, which causes charge unevenness and ground dirt to be generated. As the surface resistivity exceeds $10^8$ Ω/cm$^2$, the uniformity of the electric discharge is remarkably degraded, and the charge unevenness is generated.

It is desirable that the rate of volume specific resistance of the conductive sheet of the auxiliary electrifying apparatus be between $10^2$ Ω-cm and $10^6$ Ω-cm. It is desirable that the rate of volume specific resistance be slightly lower than the surface resistivity for obtaining uniform electric discharge. As the rate of volume specific resistance becomes less than $10^2$ Ω-cm, a current flowing between the conductive sheet and the photoconductor will cause the electric discharge between the conductive sheet and the photoconductor to be rapidly degraded.

It is desirable that the surface roughness Ra of the conductive sheet of the auxiliary electrifying apparatus be between 0.6 μm and 0.1 μm. If the surface roughness Ra is greater than 0.6 μm, the toner tends to stay, adhere, and be fixed to a concave part of fine unevenness of the surface of the conductive sheet. As the surface roughness Ra becomes less than 0.1 μm, poor adhesiveness to the photoconductor tends to rapidly generate the image background dirt.

It is desirable that the width of an auxiliary electrifying nip (a length in a direction of surface movement of the photoconductor at the position where the conductive sheet of the auxiliary electrifying apparatus contacts the photoconductor) be between 2 mm and 7 mm. As the width of the auxiliary electrifying nip becomes less than 2 mm, the charge of the residual toner and the photoconductor is rapidly degraded. If the width of the auxiliary electrifying nip is greater than 7 mm, production cost will rise due to a greater size of the apparatus.

It is desirable that the contact pressure between the photoconductor and the conductive sheet of the auxiliary electrifying apparatus be between 2 $kN/m^2$ and 15 $kN/m^2$. As the contact pressure becomes less than 2 $kN/m^2$, the contact becomes unstable. If the contract pressure is greater than 15 $kN/m^2$, the photoconductor rapidly tends to be damaged.

It is desirable that the pure-water contact angle of the photoconductor be greater than 90 degrees. As the pure-water contact angle becomes less than 90 degrees, the toner fixation to the photoconductor will rapidly take place.

It is desirable that the toner is added with an external additive in an amount of 1-4 parts by weight of the toner particles. The external additive helps reduce fixation of the toner to the conductive sheet, where the external additive intervenes between the toner particles and the conductive sheet even if the toner advances into the contact position of the conductive sheet of the auxiliary electrifying apparatus and the photoconductor. In addition, as the contents of the external additive exceed 4 parts by weight, an inadvertent influence is rapidly generated by the external additive transiting to various components.

It is desirable that the toner particles having a diameter less than 5 μm be less than 15% of all the toner particles. As the ratio exceeds 15%, toner fixation to the conductive sheet will rapidly take place.

Figure 3:
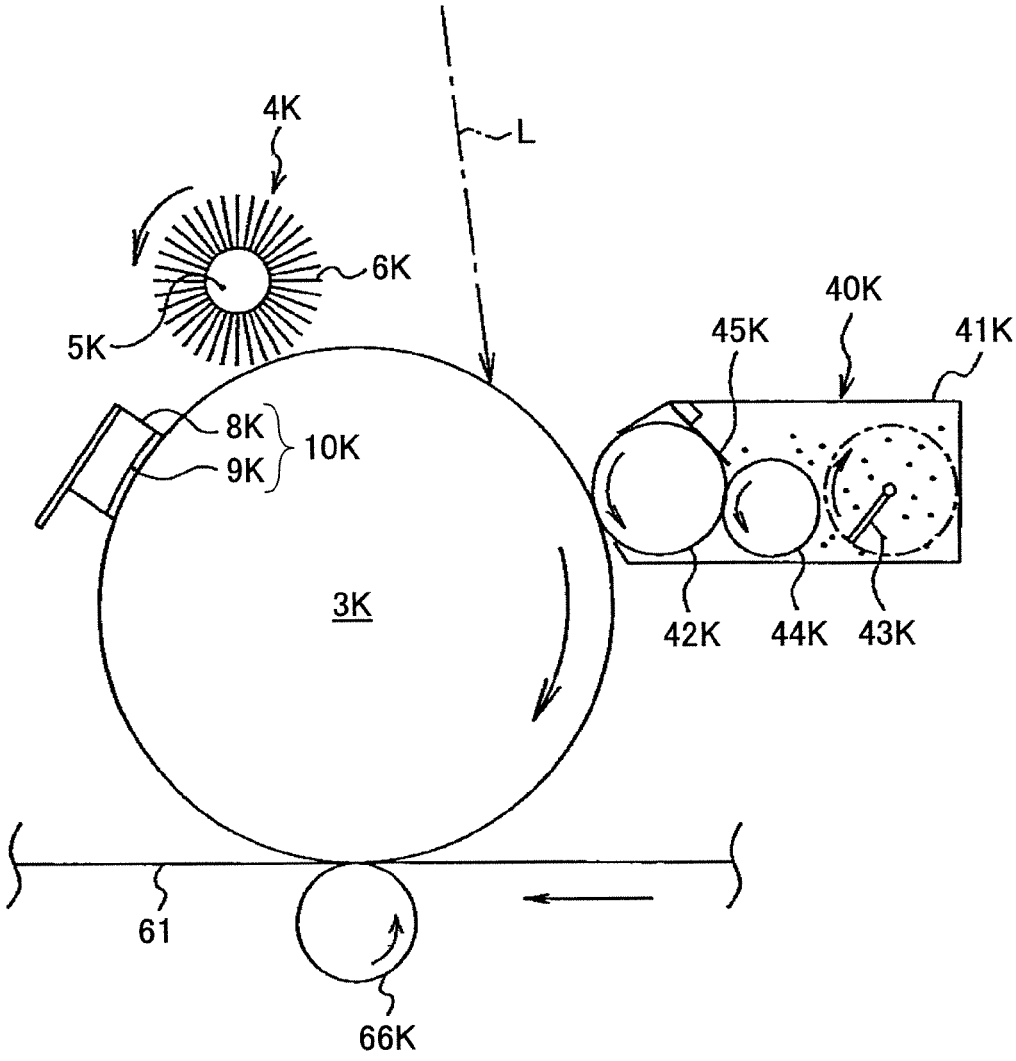
FIG. 3 is an expanded schematic diagram of the processing unit for K (black color) with a middle transfer belt according to a modification of the printer.

FIG. 3 shows the outline of a second printer that is a variation of the printer described in detail above. The modified printer (the second printer) includes an electrifying brush roller 4K instead of the electrifying roller as the electrifying apparatus. The electrifying brush roller 4K includes a metal revolving shaft 5K that is supported by bearings that are not illustrated, and two or more conductive brush-filling fibers 6K that are implanted on the surface of the metal revolving shaft 5K. The electrifying brush roller 4K is rotationally driven by a driving unit that is not illustrated in the counterclockwise direction as shown in FIG. 3, where the metal revolving shaft 5K serves as an axle, such that tips of the conductive brush-filling fibers 6K make sliding contact with the photoconductor 3K. An electric bias supply unit including a power source and wiring (not illustrated) is connected to the metal revolving shaft 5K, and an electric bias, e.g., an AC voltage to which a DC voltage is superimposed is provided to the metal revolving shaft 5K. At an electrifying nip where the conductive brush-filling fibers 6K contact the photoconductor 3K, and in its neighborhood, electric discharge occurs between the conductive brush-filling fibers 6K and the photoconductor 3K so that uniform charging of the surface of the photoconductor 3K is carried out, for example, with a negative polarity.

The modified printer employs the "temporary capture" type "cleanerless" method. Specifically, at the electrifying nip, electric discharge is carried out between the conductive brush-filling fibers 6K and the photoconductor 3K, and the negative polarity uniform charging of the surface of the photoconductor 3K is carried out. Simultaneously, by action of the electric bias, the residual toner adhered to the photoconductor 3K is transferred to the conductive brush-filling fibers 6K, i.e., the residual toner is temporarily captured. Then, the residual toner captured by the conductive brush-filling fibers 6K is transferred to the photoconductor 3K by switching the electric bias to a DC voltage from the superposed AC+DC voltage. Then, the residual toner is recovered by the development apparatus 40K from the photoconductor 3K via the developing roller 42K after finishing the print job, or between printing jobs.

Although the printer according to the embodiment and the variation thereof has been described as employing the "cleanerless" type processing unit, the present invention is applicable to a printer with a cleaning unit wherein residual toner is removed from the photoconductor surface after passing the primary transfer nip and before advancing into the electrifying nip.

Further, the present invention is not limited to these embodiments, but variations and modifications may be made without departing from the scope of the present invention.

The present application is based on Japanese Priority Application No. 2006-345331 filed on Dec. 22, 2006 with the Japanese Patent Office, the entire contents of which are hereby incorporated by reference.

What is claimed is:

1. An electrifying apparatus, comprising:

a latent-image supporting object for supporting a latent image; and a conductive member for electrifying at least one of a surface of the latent-image supporting object and toner adhered to the surface, to which conductive member a bias voltage is supplied while the conductive member contacts the surface of the latent-image supporting object; wherein a shore D hardness of a surface of the conductive member is equal to or less than 65 and the surface shore D hardness of the conductive member is equal to or greater than 50, and a surface pure-water contact angle of the surface of the conductive member is equal to or greater than 108 degrees.

2. The electrifying apparatus as claimed in claim 1, wherein a surface resistivity of the conductive member is between $10^2$ $\Omega/cm^2$ and $10^8$ $\Omega/cm^2$.

3. The electrifying apparatus as claimed in claim 1, wherein a rate of volume specific resistance of the conductive member is between $10^2$ Ω-cm and $10^6$ Ω-cm.

4. The electrifying apparatus as claimed in claim 1, wherein a surface roughness Ra of the conductive member is between 0.1 μm and 0.6 μm.

5. A processing unit used by an image formation apparatus, the processing unit comprising:

a developing unit; and an electrifying apparatus; wherein the developing unit and the electrifying apparatus are commonly held by a supporting unit that is attachable to and detachable from the image formation apparatus; wherein the image formation apparatus includes a latent-image supporting object for supporting a latent image;

a latent-image formation unit for forming a latent image on the latent-image supporting object; and the developing unit for developing the latent image on the latent-image supporting object with a toner; and the electrifying apparatus includes a conductive member for electrifying at least one of a surface of the latent-image supporting object and the toner adhered to the surface, to which conductive member a bias voltage is supplied while the conductive member contacts the surface of the latent-image supporting object; wherein a shore D hardness of a surface of the conductive member is equal to or less than 65 and the surface shore D hardness of the conductive member is equal to or greater than 50, and a surface pure-water contact angle of the surface of the conductive member is equal to or greater than 108 degrees.

6. An image formation apparatus, comprising:

a latent-image supporting object for supporting a latent image;

a latent-image formation unit for forming a latent image on the latent-image supporting object;

a developing unit for developing the latent image on the latent-image supporting object with a toner;

an electrifying apparatus for electrifying at least one of a surface of the latent-image supporting object and the toner adhered to the surface, the electrifying apparatus including a conductive member for electrifying at least one of the surface of the latent-image supporting object and the toner adhered to the surface, to which conductive member a bias voltage is supplied while the conductive member contacts the surface of the latent-image supporting object; wherein a shore D hardness of a surface of the conductive member is equal to or less than 65 and the surface shore D hardness of the conductive member is equal to or greater than 50, and a surface pure-water contact angle of the surface of the conductive member is equal to or greater than 108 degrees.

7. The image formation apparatus as claimed in claim 6, wherein a length in a direction of surface movement of the latent-image supporting object at a position where the latent-image supporting object contacts the conductive member is between 2 mm and 7 mm.

8. The image formation apparatus as claimed in claim 6, wherein a contact pressure between the conductive member and the latent-image supporting object is between 2 $kN/m^2$ and 15 $kN/m^2$.

9. The image formation apparatus as claimed in claim 6, wherein a pure-water contact angle of the latent-image supporting object is equal to or greater than 90 degrees.

10. The image formation apparatus as claimed in claim 6, wherein an external additive is added at a density of 1 through 4 parts by weight of toner particles.

11. The image formation apparatus as claimed in claim 6, wherein the toner contains less than 15% of toner particles whose diameters are less than 5 μm.

12. The image formation apparatus as claimed in claim 6, wherein the developing unit develops the latent image into a toner image with the toner that is held on a surface of a developer supporting object, a transfer unit transfers the toner image formed on the surface of the latent-image supporting object by the developing unit to a transfer object, and residual toner that remains on the surface of the latent-image supporting object after the toner image is transferred by the transfer unit is transferred from the surface of the latent-image supporting object to the surface of the developer supporting object.

* * * * *